US006651706B2

(12) United States Patent
Litt

(10) Patent No.: US 6,651,706 B2
(45) Date of Patent: Nov. 25, 2003

(54) GASOLINE PUMP SYSTEM AND METHOD

(76) Inventor: Aryeh Litt, P.O. Box 521 c/o Berman, Bridge Hampton, NY (US) 11932-0521

( * ) Notice: Subject to any disclaimer, the term of this patent is extended or adjusted under 35 U.S.C. 154(b) by 0 days.

(21) Appl. No.: 09/870,488

(22) Filed: Jun. 1, 2001

(65) Prior Publication Data

US 2001/0037839 A1 Nov. 8, 2001

Related U.S. Application Data

(63) Continuation of application No. PCT/IL00/00740, filed on Nov. 12, 2000.

(30) Foreign Application Priority Data

Nov. 16, 1999 (IL) ..... 132 973

(51) Int. Cl.[7] ..... B65B 1/04; B65B 3/04; B65B 37/00; B67C 3/00

(52) U.S. Cl. ..... 141/234; 141/242; 141/243

(58) Field of Search ..... 141/1, 9, 100, 141/104, 105, 234, 238, 242, 285, 243; 222/14, 23, 129, 134, 135; 700/241, 242, 244

(56) References Cited

U.S. PATENT DOCUMENTS 3,771,697 A * 11/1973 Sasnett et al. ..... 222/16
3,995,769 A * 12/1976 Kuwabara et al. ..... 222/26
4,250,550 A * 2/1981 Fleischer ..... 364/465
4,252,161 A * 2/1981 Krupp ..... 137/355.16
5,018,645 A * 5/1991 Zinsmeyer ..... 222/14
5,361,216 A * 11/1994 Warn et al. ..... 364/510
5,602,745 A * 2/1997 Atchley et al. ..... 364/464.23
5,926,097 A * 7/1999 Kobayashi et al. ..... 340/618
6,163,738 A * 12/2000 Miller ..... 700/239
6,191,695 B1 * 2/2001 Tatsuno ..... 340/600

* cited by examiner

*Primary Examiner*—Timothy L. Maust

(57) ABSTRACT

In a gasoline pump system, means for concurrent filling of more than one car, tank or container with gasoline or other liquid petroleum products, comprising a display for guiding car drivers to a gasoline pump system having an outlet available for fueling, and a display for enabling each driver to identify the outlet used for filling his/her car, and to distinguish it from outlets used for filling other cars. A method for concurrent filling of more than one car, tank or container with gasoline or other liquid petroleum products, comprising the steps of:

A. Guiding car drivers to a gasoline pump system having an outlet available for fueling; and B. Enabling each driver to identify the outlet used for filling his/her car, and to distinguish it from outlets used for filling other cars.

7 Claims, 9 Drawing Sheets

(2 of 9 Drawing Sheet(s) Filed in Color)

GASOLINE PUMP SYSTEM AND METHOD

CROSS-REFERENCE TO RELATED APPLICATIONS

The present application is related to the application No. 132973 filed on Nov. 16, 1999 in Israel and entitled "Gasoline pump", and a continuation to PCT application No. PCT/IL00/00740 filed Nov. 12, 2000, both filed by the present applicant.

FIELD OF THE INVENTION

The present invention relates to gasoline pumps, and more particularly to a gasoline pump with means for concurrently serving more than one car.

BACKGROUND OF THE INVENTION

Old mechanical gasoline pumps are now being replaced by new, electronic pumps. The new pumps have various benefits, for example a digital precise readout and a capability to update prices. The pump may be automatically controlled to deliver fuel up to a certain amount as desired. It was found by the present inventor, these benefits notwithstanding, that the new electronic pumps have a certain disadvantage with respect to the older pumps.

The old pumps had several outlets, corresponding to several types of vehicle fuel. Each outlet had a delivery pipe that was connected to the fuel tank in the car, and a flowmeter to measure the quantity of fuel being delivered. When one car was filled with one type of fuel, a second car could be connected to another outlet to be filled as well.

The present invention aims to concurrently service more than one customer from each side of a gasoline pump system, whereas prior art systems can only service one customer from each side of it.

Prior art patents apparently did not indicate a possibility for concurrently serving more than one car from each side of a gasoline pump system, nor do they include the necessary means for doing so. Therefore, prior art systems apparently cannot be used to reduce the waiting time and increase throughput in a crowded gas filling station.

The present situation at gas filling stations apparently attests to the difficulty/impossibility of using prior art systems to provide more effective service to customers.

Searching for ways to alleviate the problem of the crowded gas filling stations, a novel approach has identified two basic problems associated with concurrent filling of more than one car at the same side of a gas pump system, as follows:

a. In a crowded gas station, it is difficult or impossible for a driver to know where there is an available filling outlet. More so if a gasoline unit can concurrently fill two or three cars, and one or two cars are already filling there. Furthermore, the driver has to locate that filling outlet from inside his/her car, with other cars moving around.

Considering the crowded situation in a gas station, this is not a simple task (see, for example, the actual situation at a filling station in Jerusalem, in FIGS. 4 and 5). The driver preferably has to see the situation from a distance, and from outside the filling area.

Moreover, the driver has to maneuver his/her car to the available location, not a simple task under the circumstances. Thus, means for guiding car drivers to available filling outlets are required.

Accordingly, novel guiding means in the present invention allow a driver to find that available outlet before he/she enters the filling area.

b. It is necessary to enable each driver to identify the outlet used for filling his/her car, and to distinguish it from outlets used for filling other cars.

It is essential that each driver should only pay for fuel delivered to his/her car, and not for fuel supplied to others.

This essential task is further complicated in the new environment, where two or more cars are concurrently filled from the same side of the gas unit, in a crowded gas station.

Accordingly, novel means in the present invention allow a driver to ensure that he/she only pays for fuel delivered to their vehicle, by allowing him/her to reliably relate a total cost display to the fueling outlet used for filling his/her car.

Notes:

1. Throughout the present disclosure, a reference to "filling more than one car" refers to concurrently servicing more than one customer, from each side of the gasoline pump system. Prior art systems usually have two separate units, housed together, back to back, and can concurrently service two cars, but only one car from each side of the system.
2. Throughout the present disclosure, a reference to "gasoline pump system" refers to two separate units placed back to back in the same housing.

The new electronic pump also has several outlets for the various types of fuel, however it only has one flowmeter. As the desired fuel type is chosen and the corresponding outlet is coupled to the car, the flowmeter will measure the quantity of flow for that outlet. The display will indicate the cost to customer. A problem in the new pump is that, when one outlet is being used, all the other outlets are inactive. It is, therefore, impossible to fill a second car while the first car is being filled.

Prior art systems apparently do not address this problem.

Thus, Bickford, U.S. Pat. No. 3,639,735 discloses a multiple product gasoline dispensing pump with two multiple product gasoline subsystems independently operable from opposite side of the pump for selectively dispensing a plurality of different grades of gasoline. Once the product is chosen, the pump is activated for that product alone.

Krone et al., U.S. Pat. No. 3,847,302 discloses a gasoline dispensing system for delivery of regular, premium and intermediate grades of gasoline from respective regular and premium supply reservoirs comprising dispensing means including gasoline delivery hose, regular and premium metering means, first and second circuit means generating electrical pulse output, pulse combinator, variator circuit and first and second display circuitspremium metering means, and, in particular, refers to blending gasoline at different octane ratings to give an intermediate octane rating and a control relay means actuable to enable delivery flow of multiple grades of gasoline.

Atchley et al., U.S. Pat. No. 5,602,745, discloses a fuel disposal electronics design. The fuel dispenser includes a dispenser control having a plurality of microcontroller nodes and a communications bus connecting the nodes.

Atchley strives to reduce the number and complexity of wiring required in a fuel dispenser. This apparently reduces the cost of materials in the device, the manufacturing cost and the complexity of the software. It may be easier to repair the units.

The benefits claimed in Atchley relate to improvements in manufacturing and maintenance of a fuel dispenser.

Fleisher, U.S. Pat. No. 4,250,550, discloses a fuel delivery control system. A fuel delivery control system has both central and remote dispensing control stations.

Zinsmeyer, U.S. Pat. No. 5,018,645, discloses a dispensing and blending system for automotive fluids. A customer can select various fuel additives, which are automatically blended with the selected fuel. Separate switches and displays for these additives are provided in Zinsmeyer.

Miller, U.S. Pat. No. 6,163,738, discloses a point of purchase gasoline analyzing/blending.

Warn et al., U.S. Pat. No. 5,361,216, discloses a flow signal monitor for a fuel dispensing system. The system is coupled to the data wire for collecting and storing information therein.

Kobayashi et al., U.S. Pat. No. 5,926,097, discloses a fueling system including a plurality of fueling units, a control unit and an outdoor fueling indicator.

None of the above-detailed prior art patents discloses means or methods for concurrently servicing more than one customer, from each side of the gasoline pump system. Rather, apparently all these prior art systems can only service one customer from each side of the gasoline pump system.

Callahan et al., U.S. Pat. No. 4,100,400, discloses a gasoline pump price encoder for delivering pulses corresponding to the price of gasoline or other liquid petroleum products dispensed by a pump. The encoder is removably mounted on the existing mechanical price computer in the pump and includes an input gear for engaging a drive gear on the computer. A pulse generator coupled to the input gear provides pulses at a higher rate than required for the output.

Pearson et al., U.S. Pat. No. 4,107,777 discloses a fuel dispensing system comprising an operator console with means for displaying data a single location status information for dispensers of the system and a data entry keyboard; a dispenser system for controlling and monitoring a dispensing operation; a self-service fuel dispensing system providing a central control and display.

Tatsuno, U.S. Pat. No. 5,651,478, discloses an oil-feeding apparatus including oil-feeding pumps. A hose guide is provided, which guides oil-feeding hoses, each with an oil-feeding nozzle. Retractors are provided in the top housing, with wires drawn from the retractors. There is just one indicator for showing the amount of the fed oil. Additional indicators and lamps indicate the kind of oil which is being fed. The structure is devised for filling just one car at a time.

Tatsuno, U.S. Pat. No. 4,089,445, discloses a fuel filling system of a nozzle-suspended type. It includes a stationary conduit extending to a position above a passageway in the station, a motor for operating the flexible conduit for vertical movement of the nozzle. The motor is slidably arranged in the body. The system can be operated from a computer control room.

The filling system body is provided with only one means for indicating an amount of fuel dispensed and monetary amount corresponding thereto, although there are several flexible conduits for supplying various kinds of fuel. The structure is devised for filling just one car at a time.

Box, U.S. Pat. No. 5,941,418, discloses a multiple fluid dispensing system. Each vehicle service facility has a plurality of control modules. Each module can be connected to a number of pumps, a number of solenoids and a number of meters. A control module may connect to various pumps, valves and meters. The system also includes hose reels. A number of separate dispensing operations with the same or different fluids may be carried out at the same time over the networked system. This is a complex system, which is different from the presently installed electronic pumps for dispensing gasoline or other liquid petroleum products.

Tatsuno, U.S. Pat. No. 3,395,723, discloses a gasoline filling station with means for supplying fuel to vehicles from a reservoir having a fixed pipe leading therefrom, a conduit for supplying fuel, and means for supporting the conduit above the area in which vehicles are serviced. The supporting means include a reel adapted to lower and raise the conduit as required, using means for automatically rotating the reel.

The system in Tatsuno aims to remove the fuel supplying posts from the ground, by using fuel conduit means which are located above the passageway, in such a manner that an outlet can be extended downwards to reach the vehicle to be supplied with fuel.

Callahan et al., U.S. Pat. No. 4,242,575, discloses a gasoline pump digital price encoder for delivering pulses corresponding to the price of gasoline or other liquid petroleum products dispensed by a pump. The encoder is removably mounted on the existing mechanical price computer in the pump and includes an input gear for engaging a drive gear on the computer. A pulse generator coupled to the input gear provides pulses at a higher rate, that is reduced by a counter to provide a desired number of pulses per unit price.

Pusic, U.S. Pat. No. 4,900,906, discloses an automated fuel pump controlling system. The system comprises debit card vending apparatus with automated means for accepting the payment either in cash, credit or IC cards, means for automated verifying of the payment methods and means for issuing a system's debit card, and gasoline pump controlling apparatus, said apparatus comprising automated means for controlling the operation of said fuel pump activity according to information obtained from said system's debit card. Means to allow a user of said debit card vending apparatus to enter required information are also provided. The two said apparatuses are located separately, each having its own microprocessor for controlling the tasks to be performed.

Byon, U.S. Pat. No. 5,890,718, discloses a self-service gasoline pump system with game function. The gasoline pump system includes game functions in which a plurality of gasoline dispensers or pumps are respectively provided with a game device. While a pump dispenses gasoline, the game device performs a game automatically whenever a predetermined certain amount of gasoline or charge is reached, or manually whenever the user pushes a button for starting games, so as to offer premiums to the user.

Schiller, et. al., U.S. Pat. No. 5,884,607, discloses a fuel delivery system for a vehicle. It has been determined that a fuel delivery system with a fuel supply line and electromagnetically actuatable fuel injection valves produce fuel oscillations during opening and closing of the fuel injection valves and therefore generates noise, which annoys the passengers. In order to damp this kind of noise, at least one elongated, hollow damping body is connected at right angles to the fuel supply line and has a closed end.

Hartsell, Jr., U.S. Pat. No. 5,868,179, discloses a precision fuel dispenser. It has a receiver capable of receiving fueling parameters transmitted from the vehicle. The fueling parameters relate to information about tank size and maximum allowed fueling rates, among others. Based on these fueling parameters, the fuel dispenser controls the fueling operation to optimize fuel delivery and minimize fuel spillage.

Bos, et. al., U.S. Pat. No. 5,902,985, discloses a system for providing service to a vehicle positioned at a service site and billing a person or company for the service provided. The vehicle is provided with a vehicle processing unit which includes a receiver-transmitter connected to a vehicle antenna and with element for manually activating the vehicle processing unit. The service site comprises element for providing service, a site processing unit which includes a receiver-transmitter connected to a site antenna, which site processing unit includes element for registering the transaction and means for billing the person or company for the service provided.

Sasnett, Jr., U.S. Pat. No. 4,461,401, discloses a liquid dispenser assembly including a tubular housing divided into a lower compartment, a central compartment and an upper compartment.

Apparently, the system in Sasnett converts a mechanical display to an electronic display. The basic structure, however, is the same old system: each pump has its own display. There is just one price display, with several digits therein. The single display is connected to just one pump, in a one-to-one structure as in prior art. Similarly, there is just a single money display and a volume display.

The system in Sasnett et al. can fill two cars from one side of the pump system, however it has severe limitations in practical use, for example:

The dispensers do not have a local display at all, the only display being located at the remote center or booth. Such a structure is not effective in increasing the number of cars concurrently serviced at each dispenser: It may be difficult or impossible for drivers to check their respective fuel consumption, especially where there are several dispensers and a plurality of cars.

Drivers may be forced out of their cars to the remote center, thus leaving their car unattended. It may be difficult to operate a system with a multitude of drivers crowding about that remote center.

The system in Sasnett et al. can fill only two cars altogether from each dispenser, as indicated by the two hoses there. This is no improvement, in this respect, relative to prior art dispensers: rather than filling two cars one on each side of the device, the same two cars could be located on the same side of the device. The hoses are located on the sides of the housing, however there are still only two hoses.

In a modern urban filling station, space is at a premium. A capability to concurrently fill more than two cars from each side of one dispenser, housing or pump system is highly desirable.

Spalding, U.S. Pat. No. 3,100,062, discloses a remote indicating apparatus for a dispensing system. Apparently, the structure in Spalding does not include novel features relating to the basic gasoline pump structure: each pump has its own display.

Sasnett, Jr. et al., U.S. Pat. No. 3,771,697, discloses a remote control fluid dispenser having a conventional dispenser, such as a gasoline pump, and a control housing remote from the dispenser and connected thereto through electric cables. The dispenser has two nozzles and is thus capable of refilling only two cars concurrently. Although there is a double display indicated on one side of the dispenser, it is done at the expense of no display at all on the other side thereof.

The double display refers just to the two above mentioned nozzles—the only difference is that the usual two displays, rather than being located each on one side of the dispenser, are both located on the same side of the dispenser.

There is no teaching nor indication in Sasnett of a capability to concurrently fill more than one car from each side of the dispenser, nor are means disclosed that are directed to that purpose.

Prior art fuel dispensers contain, within one housing, two fuel dispensing systems, each on one side of the device, each capable of filling just one car at a time. Thus, the whole housing can fill, at most, two cars concurrently.

Relocating one display to the other side of the housing, as is done in Sasnett, does not improve the system's capabilities in this respect—it still can fill just two cars concurrently. If two cars are located on the same side of the refueling island, and if the hose can be transferred from the other side of the device such as to fill two cars on one side of the device, then no additional cars can be filled from that other side of the housing in prior art systems.

Thus, even such maneuvering cannot increase the number of cars that can be concurrently filled from prior art fuel dispensing systems.

Kuwabara et al., U.S. Pat. No. 3,995,769, uses more surfaces, with just one car being serviced on each surface.

Similar considerations apply to Tatsuno, U.S. Pat. No. 6,191,695 and Krupp, U.S. Pat. No. 4,252,161.

The novelty in the present invention relates, inter alia, to a capability to concurrently fill more than one car from each side of a fuel dispensing system.

Throughout the present disclosure, the terms "gasoline pump system" or "fuel dispenser" or "housing" refer to a physical fueling unit or "box"; a reference to "filling more than one car" refers to concurrently filling of more than one car on each side of the fueling unit.

A housing may include one fueling unit with hoses and display, which is capable of filling one car at a time.

A prior art housing may include two fueling units, back to back, in which case two cars can be concurrently filled.

Still, all prior art systems can fill just one car from each side of the housing.

The present invention addresses the problem of concurrently serving more than one car, as well as other problems in gasoline pumps.

SUMMARY OF THE INVENTION

The present disclosure relates to improvements in electronic pumps for dispensing gasoline or other liquid petroleum products to allow the concurrent filling of more than one vehicle, tank or container. If one pump can concurrently fill two cars, then the waiting time for each car other than the first is significantly reduced. This is an important benefit to customers and may increase the number of customers of a gas station. As cars approach the station and the drivers see several cars waiting, they may choose to avoid that station altogether, and drive to another station. In this way, business may be lost to the gas station owner.

By providing means for concurrently serving more cars, the present invention may therefore increase the turnover of gas service stations, without the need to add more gasoline pumps.

The new means for concurrently serving two or more cars from the same side of a gasoline pump system comprise two novel components, which act together to provide the claimed novel benefit:

a. Means for guiding car drivers to available filling outlets, during a first stage—prior to fueling. That is, the guiding means indicate for a gasoline pump system, whether there is an available outlet there for filling another car.

b. Means to enable each driver to identify the outlet used for filling his/her car, and to distinguish it from outlets used for filling other cars.

Benefits in the New System and Method

The following novel benefits, for example, are achievable with the present invention:

a. Improving service to customer. Reduce a driver's waiting time at a gasoline filling station.

b. Energy savings—numerous cars, waiting for prolonged time periods for fueling, consume fuel to no purpose.

c. Environmental protection—less fumes from idle, waiting cars. Less noise.

d. Increased efficiency at gas station—more cars can be serviced during the same time period. Increased profits, without an increase in the area of the gas filling station (real estate).

e. Better service to the community, especially in urban areas, where the alternative would be to expand the area of a gas filling station, a very expensive or impossible task.

According to one aspect of the invention, the gasoline pump includes means for simultaneously handling two cars. The pump includes electronic means for inputting data from two flowmeters, each connected to a fuel outlet. For each outlet, the cost of the delivered fuel is computed based on the volume of delivered fuel, a predefined price list and the type of fuel selected. Display means display of the amount of delivered fuel and of the price for each car being serviced.

The pump may include further display means that indicate what type of fuel was chosen by the car now filling. This may help another car driver to decide whether he/she can now use that pump as well. That is, if the second car needs a different type of fuel than that which is now filling, then the second car may be served concurrently with the first.

According to another aspect of the invention, more than two cars may be serviced simultaneously. In one embodiment, each outlet can supply a different type of fuel.

In another embodiment, two or more outlets can supply the same type of fuel, to adapt the station to actual users demand. The more popular types of fuel can thus be made available at more outlets.

A practical approach uses the available components in the gasoline pump and the advanced capabilities that electronic devices can now provide at low cost.

According to yet another aspect of the invention, the fuel delivery to each car may be individually controlled, for example by limiting the transaction to a specific amount.

There is a fusion, or integration, between signals from the various pumps, each of the two displays can service any of the various pumps. A novel, sophisticated structure is presented, using advanced electronics. Flexible operation and improved performance can thus be achieved.

The scope and spirit of the invention are illustrated with the inclusion of specific applications thereof.

Further objects, advantages and other features of the present invention will become obvious to those skilled in the art upon reading the disclosure set forth hereinafter.

BRIEF DESCRIPTION OF THE DRAWINGS

This patent or application file contains at least one drawing executed in color. Copies of this patent or patent application publication with color drawing(s) will be provided by the Office upon request and payment of necessary fee.

DETAILED DESCRIPTION OF THE PREFERRED EMBODIMENTS

A preferred embodiment of the present invention will now be described by way of example and with reference to the accompanying drawings.

The means for concurrently serving two or more car from the same side of a gasoline pump system comprise two novel components, which act together to provide the claimed novel benefit:

a. Means for guiding car drivers to available gasoline pump units, during a first stage—prior to fueling. These means include, for example, the display 4 in FIG. 1, which is visible to drivers who are looking for an available filling outlet.

b. Means for enabling each driver to identify the outlet used for filling his/her car, and to distinguish it from outlets used for filling other cars. These means include, for example, the different fuel types and the corresponding display in FIG. 1, or the unique identification means 357, 367 for each fuel outlet in FIG. 9.

Figure 1:
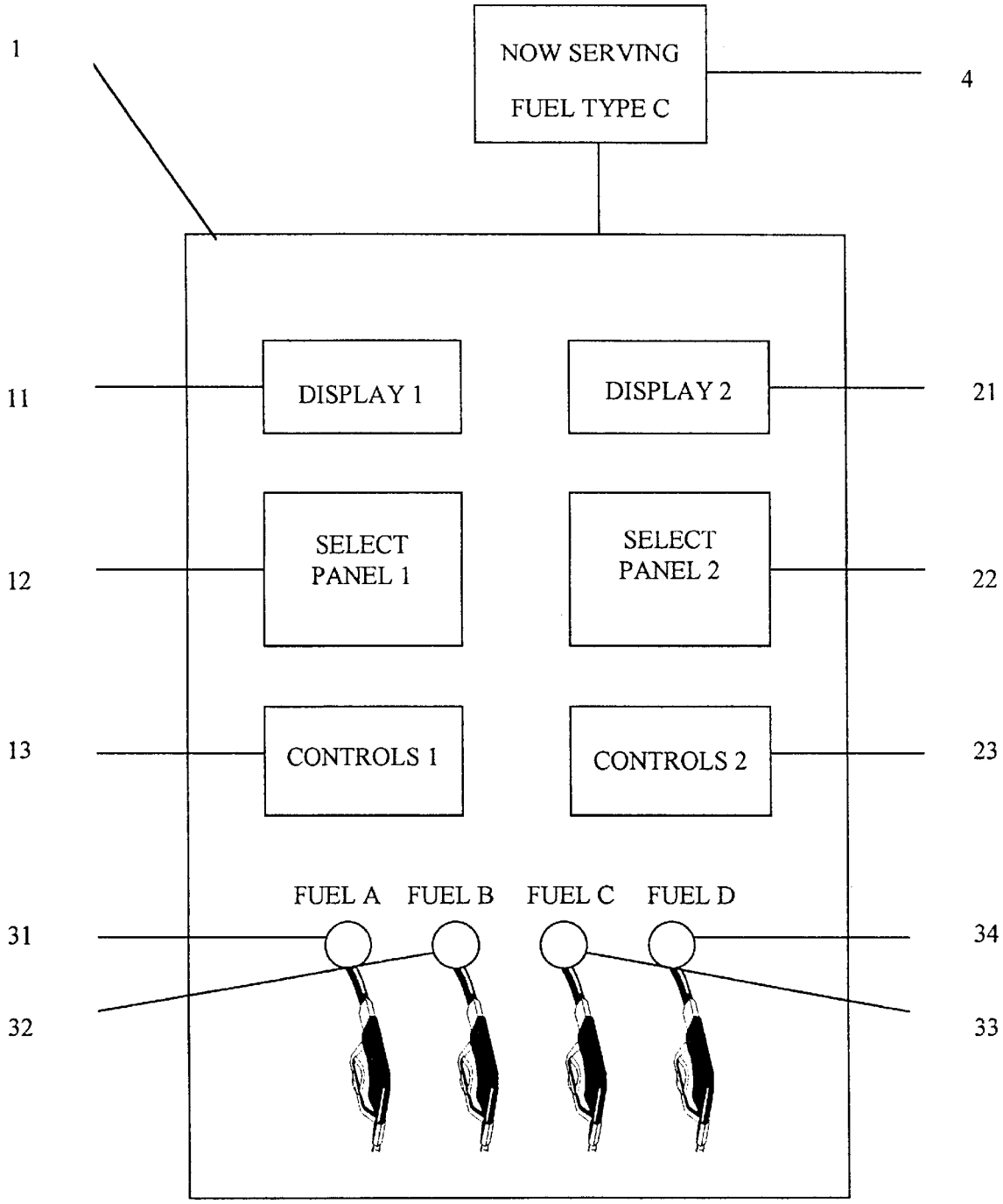
FIG. 1 illustrates a gasoline pump system with means for serving two or more vehicles at the same time.

FIG. 1 illustrates a gasoline pump system (1) with means for concurrently serving two cars, though the principle will of course apply for more than two vehicles.

To this purpose, the system (1) includes two sets of interface means with a station operator, each set relating to one serviced car. The first set includes a first display (11), a first fuel selector (12) and a first control panel (13). Accordingly, the second set includes a second display (21), a second fuel selector (22) and second control panel (23).

The gasoline pump system further includes outlets for several types of fuel, as illustrated with fuel A outlet (31), fuel B outlet (32), fuel C outlet (33) and fuel D outlet (34).

In another embodiment, there may be two or more outlets used for the same type of fuel.

Display means 4 may operate in one of several ways, according to implementation:

1. In case each outlet supplies a different type of fuel and the system can supply up to two cars at the same time, then display 4 indicates the type of fuel now being served. This information can be used by the driver of a second car as indication that he/she can fill a different type of fuel.

2. In case each outlet supplies a different type of fuel and the system can supply more than two cars at the same time, then display 4 indicates all the types of fuel now being served. Drivers then know what types of fuel are not available at that station.

3. Display 4 can indicate all the types of fuel that can be served, that is those corresponding to free outlets (outlets not in use now). Thus, each driver can look around to search for the type of fuel he/she needs.

Figure 2:
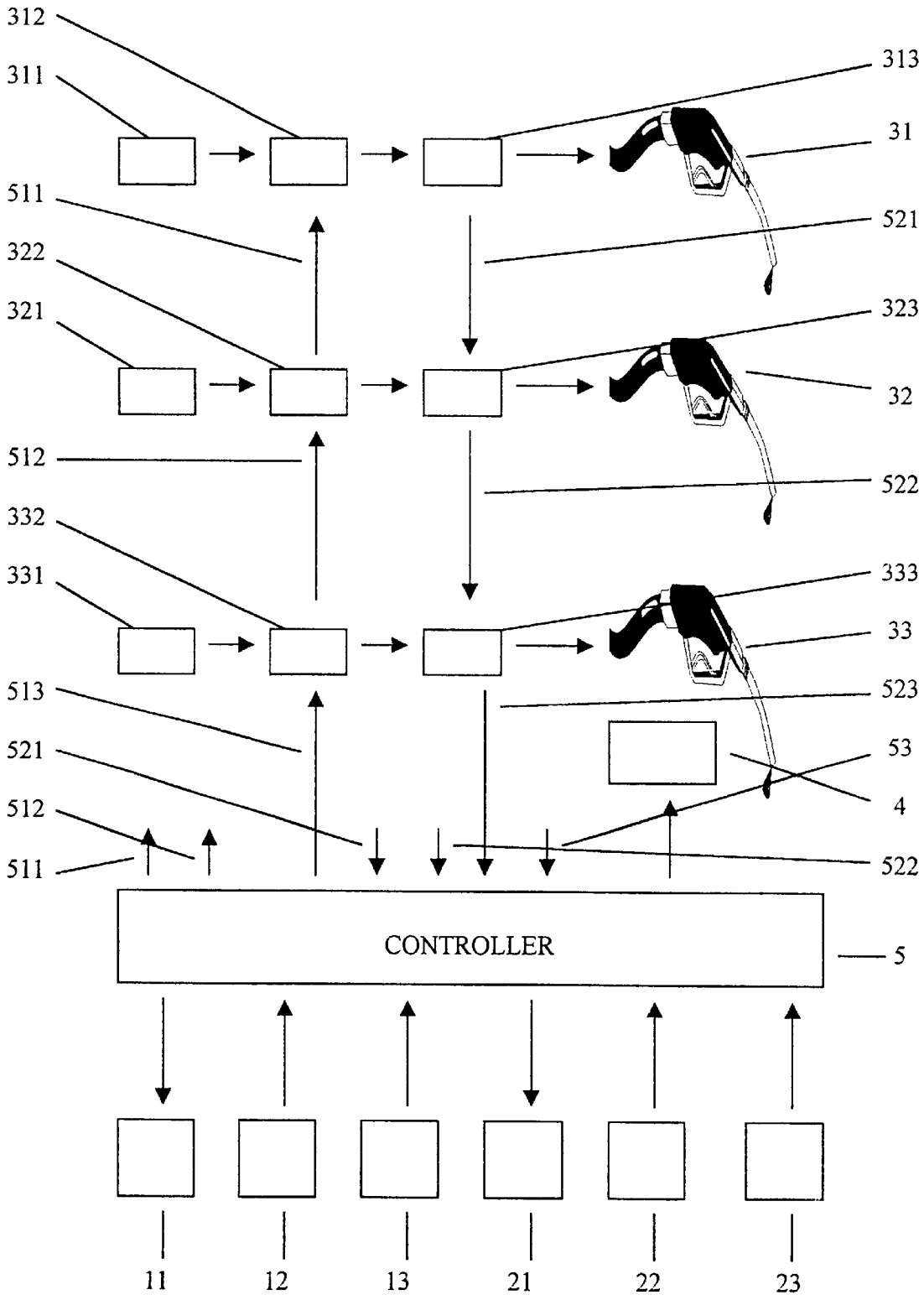
FIG. 2 details the structure of a gasoline pump system with means for concurrently serving more than one vehicle.

In another embodiment of the invention (not shown), the pump activation commands are not entered through the controls 1 or 2 into controller 5 (see FIG. 2). Rather, each fuel type pump is activated independently using a dedicated input controller for that purpose, for example a pushbutton for each fuel type.

The controller 5 receives electrical signals indicative of the commands to each fuel pump, and monitors the corresponding flowmeter—that is, the flowmeter associated with the pump and type of fuel being activated, as detailed with reference to FIG. 2.

The controller is connected to a plurality of display means, each associated with one type of dispensed fuel. The display is activated for the selected fuel type, from which outlet in the pump it is dispensed, to indicate the amount of fuel delivered and the cost. Several display units may be activated at the same time, each corresponding to one fuel type being delivered.

In this embodiment, the controller does not participate in the actual filling, but only in the display to user and the computation of cost. Such an embodiment may involve higher cost, as it requires one display for each type of fuel. A possible advantage is its ease of adaptation to older filling stations, that retain the manual control over the filling operations, while providing improving display and cost computation means, that are possible using newer, electronic controllers.

The digital controller used in the present invention has many advantages. For example, it is possible to implement a dual display system (not shown). The controller may activate a main unit for displaying the filling status at the pump, and a remote unit for displaying the filling status at a remote location, for example in the office. Each unit may display filling status information for several cars that are serviced at the same time. A communication link may be used to connect to the remote unit, using a serial, digital communication channel as known in the art.

Several digital controllers, each for one fuel pump, may be connected together through a digital channel and to a remote display, to transfer display information from all the fuel pumps in a gasoline filling station to a central display at a remote location. A hard wire or a fiber optics link may be used, for example, to implement the digital channel.

METHOD OF OPERATION

The following illustrates the operation of the gasoline pump system (1):

A. A car arrives and the driver chooses a desired type of fuel, for example fuel type C;

B. The station attendant chooses fuel C with select panel (12). The fuel pump for fuel type C may be activated immediately or with a specific command on control panel (13). The control panel (13) may also be used for other purposes, for example to set a desired amount for the filling or the desired volume of fuel;

C. The car is filled with the desired fuel C, while the display (11) indicates relevant information like the volume of fuel and/or amount due. An additional display (4), visible to a driver entering the filling station, will indicate the type of fuel now being served. This will serve as an indication to other drivers, that this pump may now serve any type of fuel except fuel type C;

D. If a second car arrives at the gasoline pump, its driver indicates the desired fuel type, for example type A. The station attendant sets the desired fuel using fuel selector (22), and optional control panel (23).

Filling-related information for the second car is indicated on display (21). The procedure for the second car is identical to that for the first car as detailed above, with the exception that a second set of display/controls is used. The display (4) now indicates that no further cars can now be serviced at this pump, as the maximum of two cars has been reached.

E. When a car finishes filling, the display (4) is updated accordingly. For example, when the first car leaves, then display (4) indicates that all types of fuel are available except type A.

F. When no car is being served (for example, after the second car left as well) the display (4) will indicate that all types of fuel are available from the gasoline pump.

End of method.

Notes:

1. Each outlet can supply a predefined type of fuel. These may be different types of fuel, or the same fuel type can be delivered at more than one outlet.

2. The additional display (4), visible to a driver entering the filling station, can either indicate the type of fuel now being served, or the types of fuel still available at that station.

3. In the above method Step D, the same fuel type C can be supplied to the second car if fuel type C is being dispensed from more than one outlet. If fuel type C is only made available at one outlet, then the second car cannot be supplied with that fuel type.

4. In the above method Step D, more than two cars can be serviced at the same time if the system structure supports that. The controller has to include the capability of processing at the same time inputs from more than two flowmeters, and the installation has to include means for delivering fuel to more than two cars at the same time. In that case, the display (4) will indicate that no further cars can be serviced at this pump, when the maximum number of cars being serviced at the same time has been reached.

5. In the above method, the station may be of a self service type. In this case, the driver activates the pump controls. Also, part of the controls may be located in a location away from the gasoline pump.

FIG. 2 details the structure of a gasoline pump system with means for concurrently serving two vehicles. For the sake of clarity, a pump with only three types of fuel is illustrated, though the principle will of course equally apply to any number of types, and to more than one outlet supplying the same type.

The operation of the system is controlled by an electronic controller (5). The controller (5) may be implemented with a microcomputer, a digital signal processor (DSP) or other digital device as known in the art.

The controller (5) may have a parameters setting input (53), that may be used to set prices for the various fuel types etc. An additional display (4) indicates what type of fuel is now filling or what types of fuel are now available, to help drivers choose a gas pump.

A first interface means set includes the first fuel selector (12) and first control panel 13 that transfer user's commands to controller (5), and the first display (11) that indicates the filling status for a first car.

Similarly, the second interface means set includes the second fuel selector (22) and second control panel (23) to transfer user's commands regarding a second car filling at the station, and the second display (21) that indicates filling status for that car.

For fuel type A, there is a fuel A reservoir (311) with a fuel A pump 312 and a fuel A flowmeter (313) connected to a fuel A outlet (31) that delivers fuel to a car. When a user chooses fuel A, controller (5) activates pump (312) through a pump A control line (511). The flowmeter (313) transfers its reading to the controller (5) through a fuel A sense line (521). Controller (5) displays the volume of delivered fuel based on the information from the flowmeter (313). The controller (5) computes the cost of the fuel according to the fuel price list in its memory and the volume of fuel, and displays the cost as well.

The system may further include automatic sensor means (not shown) for stopping the pump (312) when the tank is filled, as is known in the art. The controller (5) may be also notified that the pump was stopped, so that another car may be received. Alternately, controller (5) may stop the pump (312) responsive to a sensor's indication that the tank is full.

Similarly, for fuel type B there is a fuel B reservoir (321) connected to a fuel B pump (322), a fuel B flowmeter (323) and a fuel B outlet (32). The pump (322) is activated through pump B control line (512) under the supervision of the controller (5). A fuel B sense line (522) is used to transfer flowmeter (323) readings to the controller (5).

For fuel type C, there is a fuel C reservoir (331) connected to a fuel C pump (332), a fuel C flowmeter (333) and a fuel C outlet (33). Controller 5 can activate pump (332) through pump C control line (513). The flowmeter (333) readings are transferred to controller (5) through a fuel C sense (measuring) line (523).

The modular structure detailed above may be used for a larger system, with more fuel types. Each fuel type requires a separate reservoir and may use a separate pump and flowmeter.

In another embodiment, more than one outlet may dispense the same type of fuel.

In yet another embodiment, a fuel selector (not shown) may be used, in which case less pumps and flowmeters may be required. It may be possible to serve more than two cars concurrently. An electronic controller (5) may handle a plurality of cars, with more pumps being activated concurrently and more flowmeter readings being processed. In this case, more control sets may be required, each relating to one car being filled. In this case, the additional display (4) may indicate several types of fuel now being served.

For the sake of clarity, the above description refers to a system with only one active side, that is a device wherein there are fuel outlets, displays and control means only on one side of the device. In practice, however, pump systems usually have two units back to back. Each unit is activated independently of the other. For three types of fuel, there are two sets of three fuel outlets, for a total of six outlets per device. For an electronic system, the above detailed problem exists for each pump unit—only one fuel outlet may be active at any given moment.

The present invention may also be applied to the dual unit system. To each of the two units therein, a controller may be provided as previously detailed, that allows two outlets to be concurrently active. For each of the two units, an additional display indicates the type of fuel now being served, or the types of fuel available, if any.

The dual unit allows for a more effective implementation, wherein a common controller controls the two units. That is, one electronic device may receive information from all the flowmeters in the two units and from all the control panels. It will concurrently respond to control the two units, each according to its state and its operator's commands.

The above embodiment for a dual pump system may be applied to the various systems and methods detailed in the present disclosure.

Throughout the present disclosure, it is to be understood that the electronic controller need not control several devices simultaneously. A digital computer, controller or microcomputer may supervise a wide variety of devices like control panels, flowmeters, pumps, etc. Usually, the controller will access these devices sequentially. The high speed of modern digital controllers ensures a fast response to any event in any of the supervised devices. For all practical purposes, the computer controls the concurrent operation of two or more pump units. This implementation is made possible with the very fast electronic computers now available. The controller includes input/output means as known in the art for interfacing with the various devices in the gasoline pump system.

Although the present disclosure illustrates, by way of example, the invention being applied to a specific type of gasoline pump, it is to be understood that it may be applied as well to various gasoline pump structures, without departing from the scope and spirit of the present invention.

In one embodiment of the invention, new gasoline pump systems may be manufactured with a capability to concurrently fill two or more cars. In another embodiment, existing gasoline pump systems may be retrofitted with the addition of a new digital controller. Wherever necessary, interface means with existing fuel pumps, flowmeters and/or other devices therein may be provided as well. This will improve existing gasoline pump systems by adding the capability to concurrently serve more than one car.

Similarly, in another embodiment, not only vehicles can be served by the gasoline pump but also any tank, can or other container.

Research work has been conducted for investigating the utility of the invention.

One research issue relates to the practical feasibility of bringing two cars so close to the same gasoline pump system, as to allow simultaneous filling of both cars. Is there enough free space available in a gas station, to allow bringing two cars close enough to the same gasoline pump system?

Another research issue refers to the assumption that, if space permits, then any gas station will include the maximal number of gasoline pump systems possible therein, to allow simultaneous filling of all the cars present.

Figure 3A:
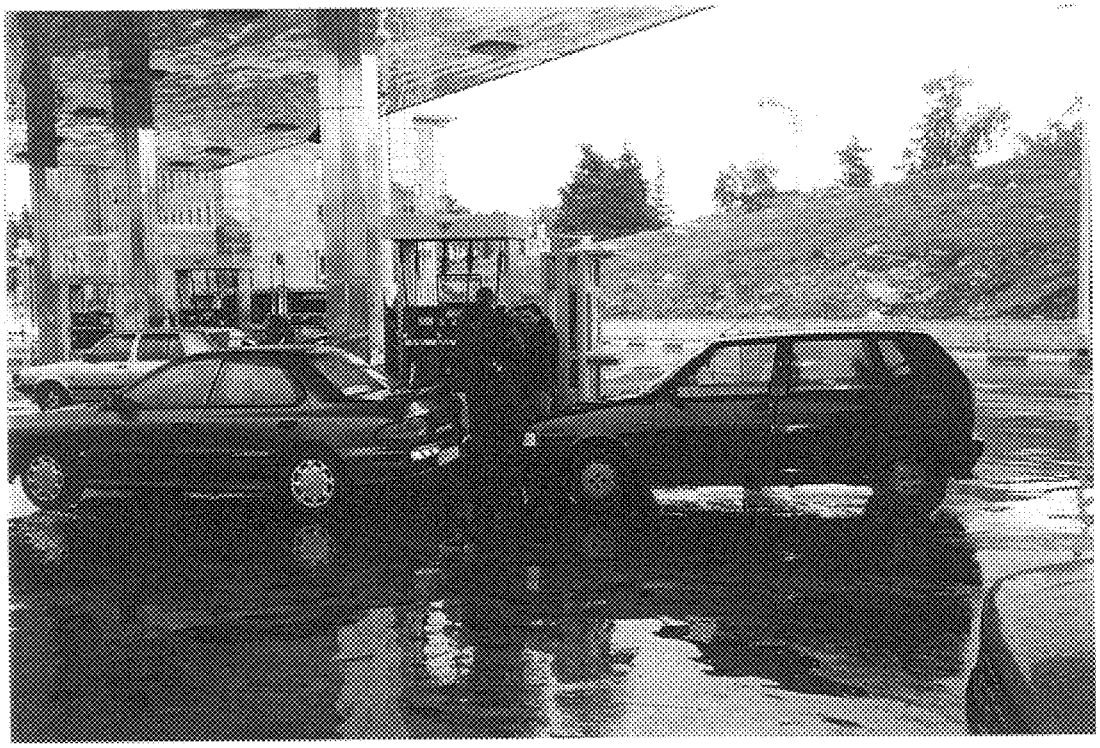
FIG. 3 illustrates the problem in filling more than one car at a gas station.
Figure 3B:
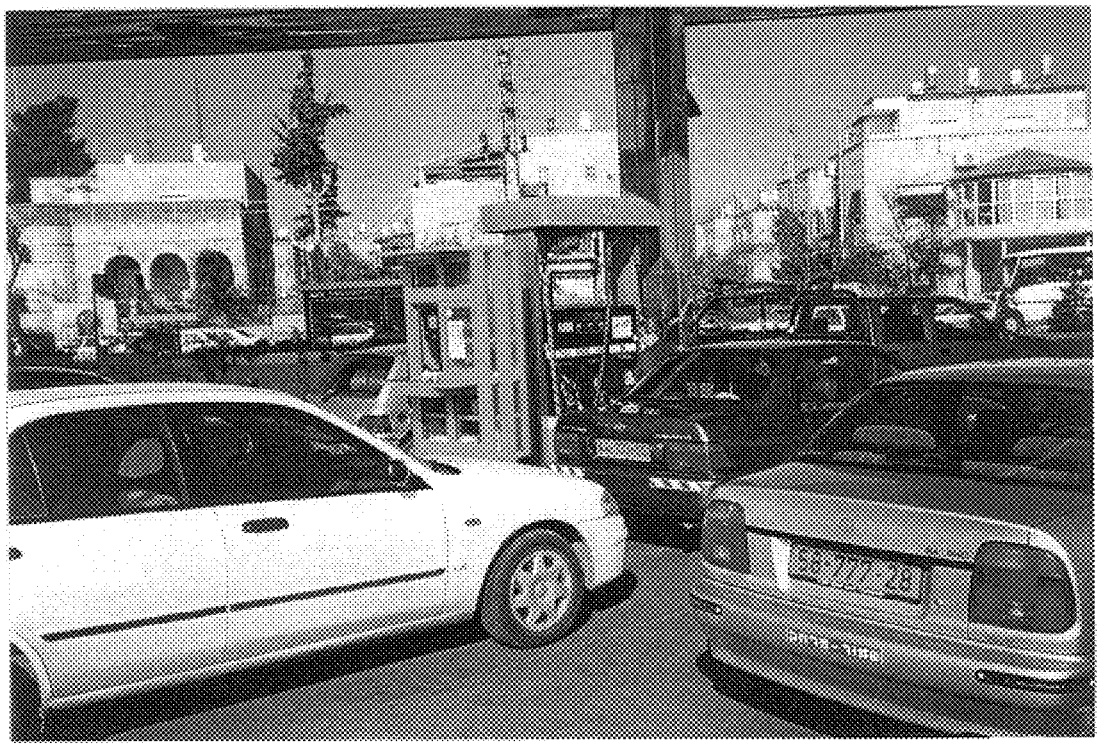

To answer these questions, the applicant has investigated the actual filling operations at gas stations. The attached photographs (FIG. 3) were taken on a Wednesday and a Friday at the Paz Allenby gas station on 99 Derech Hebron, Jerusalem. See also FIGS. 4 and 5.

Figure 4A:
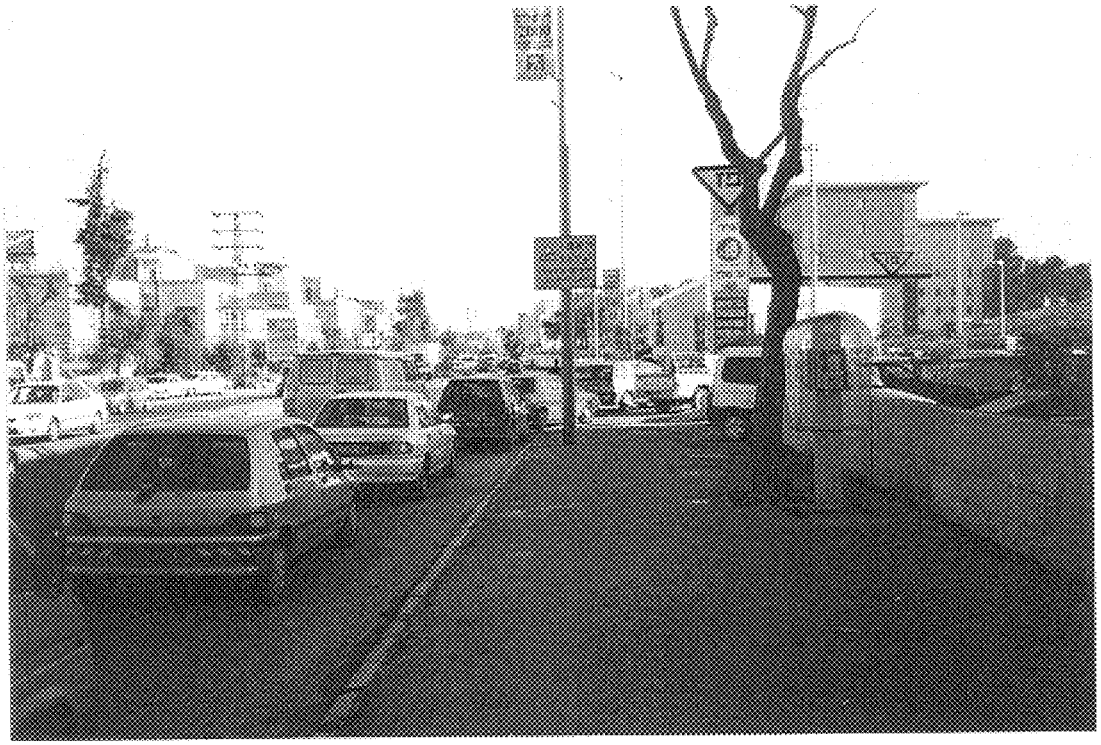
FIG. 4 illustrates the heavy workload at gas stations.
Figure 4B:
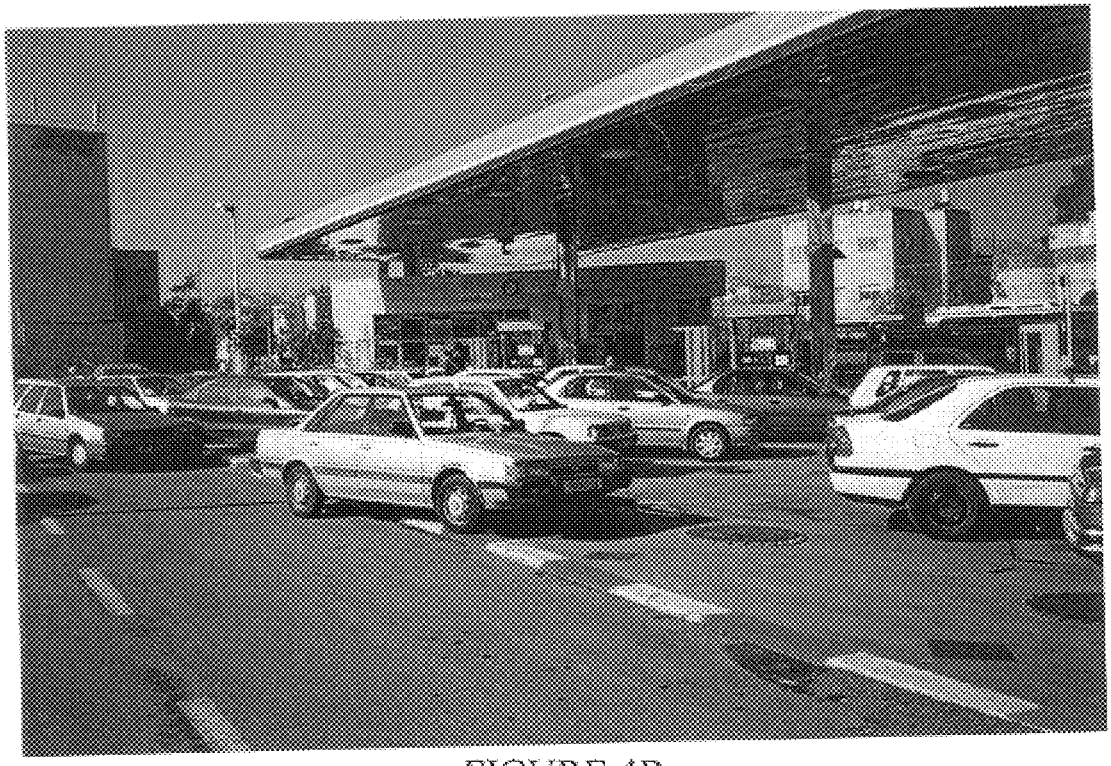
Figure 5:
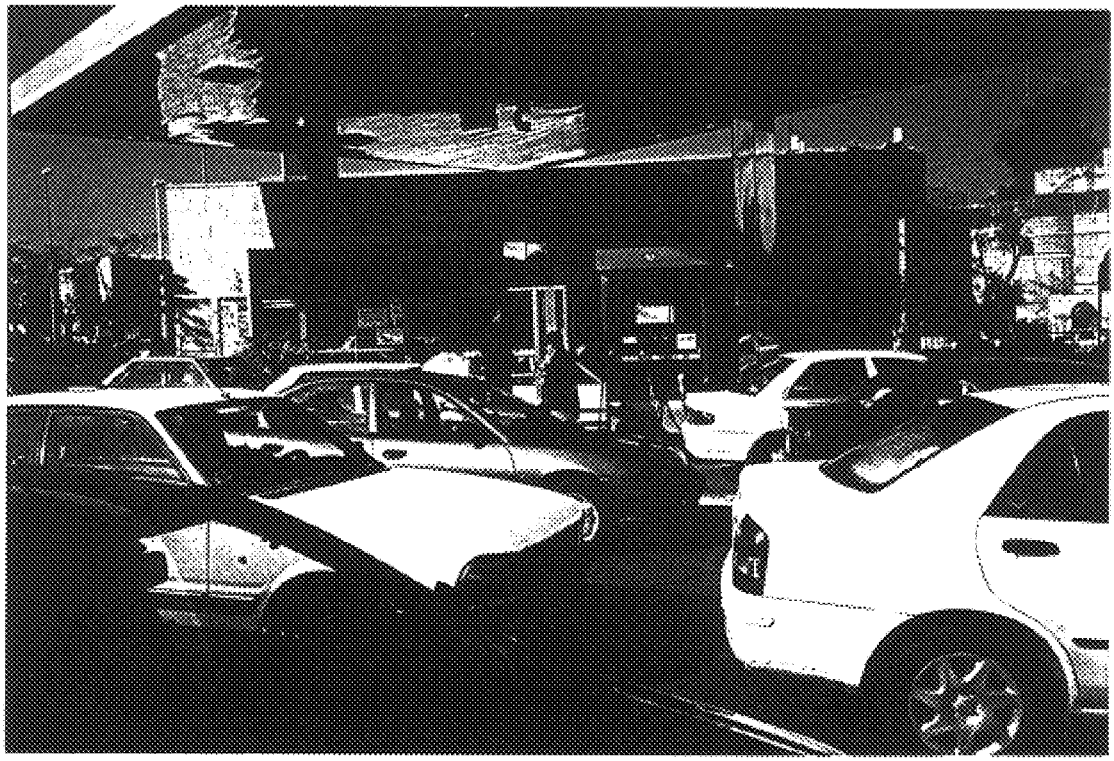
FIG. 5 further illustrates the heavy workload at gas stations.

Further results of the applicant's investigation are presented in FIGS. 4 and 5, with the photographs therein clearly illustrating the heavy workload at gas stations on Fridays. There are many cars waiting, both inside the gas station as well as on the road outside it.

Several conclusions have been drawn from this research, as follows:

1. Yes, apparently it is practically feasible to fill two cars simultaneously from the same gasoline pump system, while the cars are located on the same side of the pump.

The invention may not be applicable in gas stations where there is not enough room for two cars to be close enough to the same gasoline pump system.

In many gas stations, however, there is enough space for two cars to be filled simultaneously from the same gasoline pump system.

Therefore, the present invention can be used in part of the gas stations, where there is room enough for two cars to be brought close to the same gasoline pump system.

To illustrate an example of the feasibility of the invention, the attached Photograph A (FIG. 3) clearly shows two cars close to a gasoline pump system, both cars located on the same side of the pump. Both cars could be simultaneously filled, if the gasoline pump system were improved according to the present invention. At present, just one car can be serviced at one time.

2. Actually, there are two possible ways to use the invention: the two cars can either be located one after the other, as illustrated, or side by side. Photograph A indicates there is plenty of room for two cars to be located side by side, on the same side of the gasoline pump system.

The attached Photograph B (FIG. 3) also illustrates the two possible ways of concurrent filling of two cars: there are three cars near the gasoline pump system. Two of them could be filled simultaneously using the present invention. See also FIGS. 6, 7 and 8 below and the related description.

The above conclusion refers to cars located on the same side of the gasoline pump system, since the present invention teaches of a device for filling two cars from the same side of the pump. This represents an improvement over existing gasoline pumps, which can only fill one car on each side of the pump.

At present, gasoline pump systems can concurrently fill two cars using two pumps, each located on one side of the device.

The present invention allows to concurrently fill four cars from the same gasoline pump system, by filling two cars from each side of the pump. Using the present invention, therefore, allows a gas station to service more customers, faster.

3. There is a need for the present invention, since at rush hours there are many cars waiting at a gas station. The attached Photograph B illustrates the long queue of cars waiting on a Friday at a gas filling station. Therefore, it appears that the present invention is particularly useful during rush hours such as on Fridays, when the workload is at a maximum and there are many cars waiting.

4. Preferably, one of the fuel hoses may be made longer, to be capable of reaching a car which is located farther away from the gasoline pump system 1. In actual use, the first car or the car which is closer to the pump will be filled using the shorter hose, whereas the second car or the farthest car will be filled from the longer hose.

The longer hose may be attached to an overhead pipe so as to prevent it from trailing on the ground. This may help prevent damagage to the hose by a car driving over it.

Alternately, a telescopic tube can be used for the same purpose.

Figure 6:
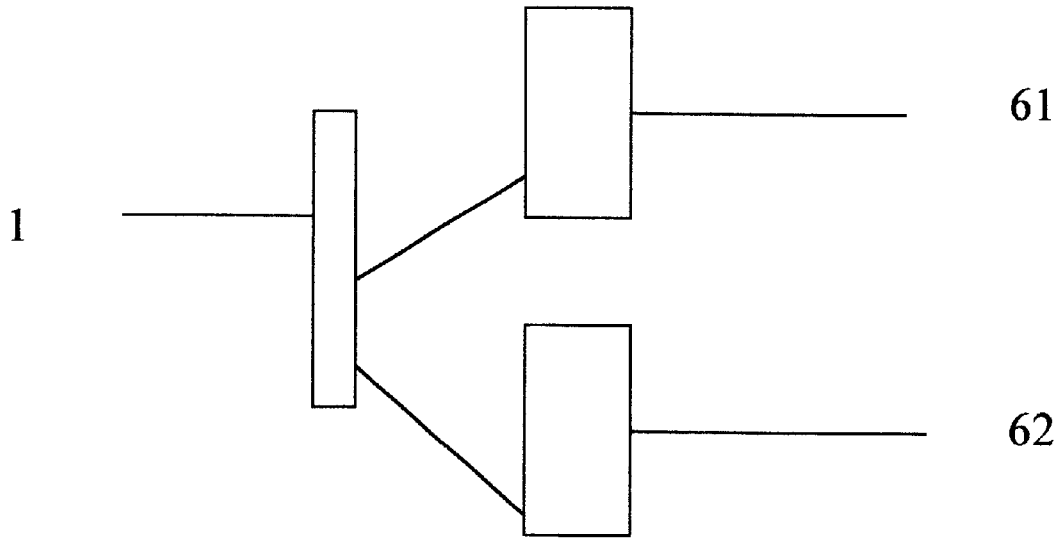
FIG. 6 illustrates a top view of a possible case, wherein the cars are located one after the other.

FIG. 6 illustrates a top view of one possible case, wherein the cars 61 and 62 are located one after the other, both on the same side of the gasoline pump system 1.

In this case, car 61 can use the shorter hose, whereas car 62 may use the longer hose.

Figure 7:
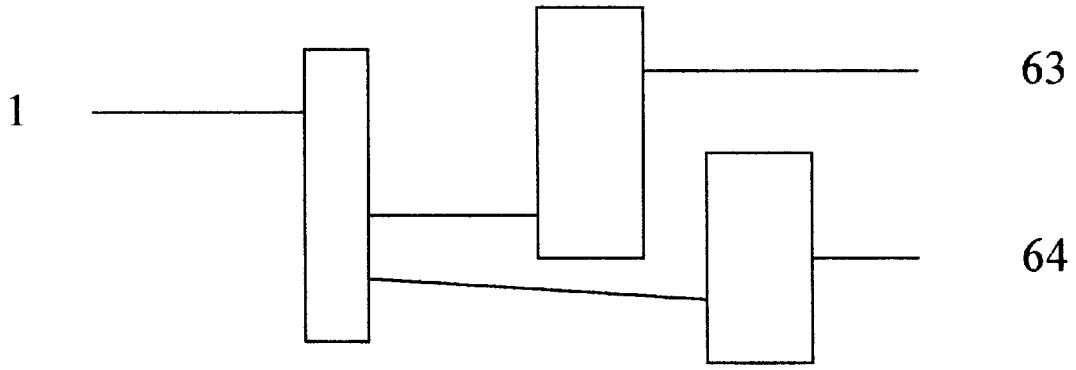
FIG. 7 illustrates a top view of a second possible case, wherein the cars are located side by side, on the same side of the gasoline pump system

FIG. 7 illustrates a top view of a second possible case, wherein the cars 63 and 64 are located side by side, both on the same side of the gasoline pump system 1.

In this case, car 63 can use the shorter hose, whereas car 64 may use the longer hose.

Figure 8:
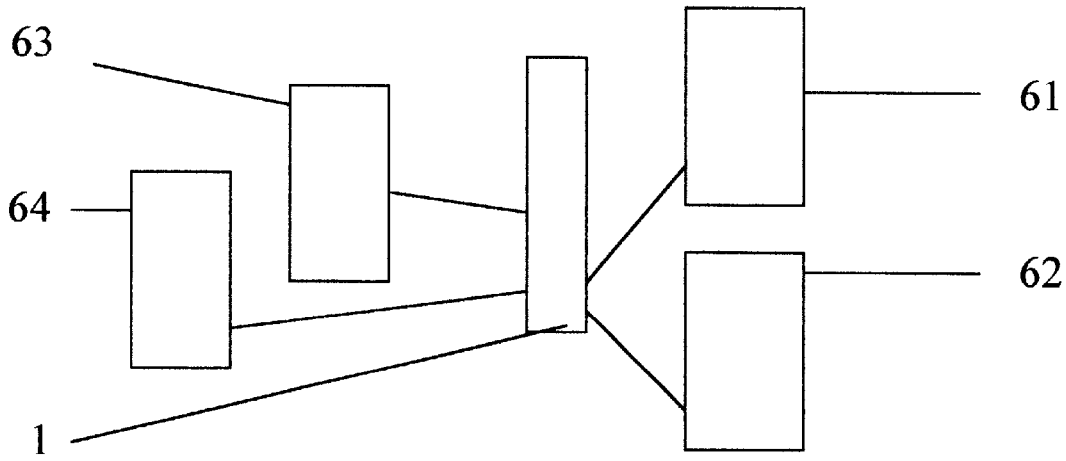
FIG. 8 illustrates a practical implementation of the invention in a two-sided gasoline pump station.

FIG. 8 illustrates a practical implementation of the invention in a two-sided gasoline pump station 1. One side of the pump can now service two cars 61 and 62, and the other side can service the two cars 63 and 64. In prior art electronic pumps, each side of the pump could only service one car.

Figure 9:
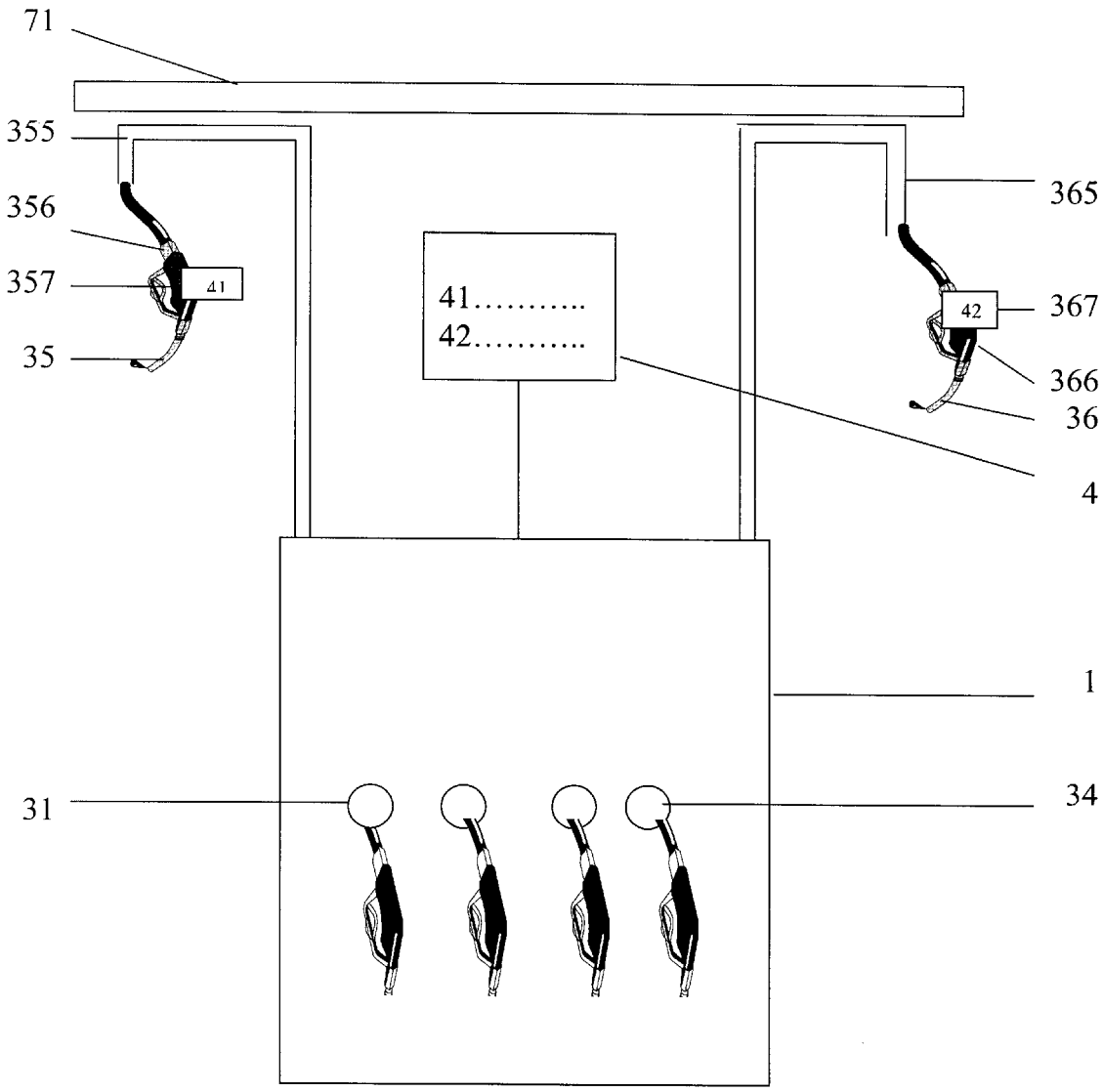
FIG. 9 details a gasoline pump station with overhead supply pipes.

FIG. 9 details a gasoline pump station with overhead supply pipes. This structure can supply fuel to vehicles that are located anywhere in the gas filling station.

In one embodiment, a first overhead fuel outlet 35 includes a long pipe 355 for delivering fuel from the system 1 through a pipe 355. Pipe 355 is preferably secured to overhead support means 71.

This will prevent the pipe 355 from lying on the ground.

The pipe 355 may include a telescopic portion 356, to connect to a car without interfering with passing cars.

The outlet 35 may include identification means 357, for example a unique number, color and/or shape.

The same identification means is displayed on the system 1, for example on display 4, together with filling information such as fuel volume, type and cost. Thus, the customer can verify there are no mistakes with the billing for the fuel.

Preferably, a large display means 4 is used, to facilitate reading the displayed information from a distance, where the driver may be located when filling his/her car using one of the overhead outlets.

Outlet 35 can be connected in parallel to an existing outlet such as outlet 31. Thus, that fuel type can be supplied either through outlet 31 or outlet 35, according to the location of the vehicle to be supplied.

Similarly, a second overhead fuel outlet 36, includes a long pipe 365 for delivering fuel from the system 1 through a pipe 365, which is preferably secured to overhead support means 71. The pipe 365 may include a telescopic portion 366. The outlet 36 may also include identification means 367, for example a unique number, color and/or shape.

Outlet 36 can be connected in parallel to an existing outlet such as outlet 34. Thus, that fuel type can be supplied either through outlet 34 or outlet 36, according to the location of the vehicle to be supplied.

In another embodiment, both a second overhead fuel outlet 37 is provided including a long pipe 375 for delivering fuel from the system 1 through a pipe 375 which is preferably secured to overhead support means 71. These overhead support means may include a telescopic portion 72. The pipe 375 may also include a telescopic portion 376. The outlet 37 may include identification means 377, for example a unique number, color and/or shape.

Outlet 37 can be connected in parallel to an existing outlet such as outlet 31.

Thus that fuel type can be supplied either through outlet 31 or outlet 37, according to the location of the vehicle to be supplied.

This provides for one car to be at the pump and the two in front (or behind) can be serviced at the same time. The preferred embodiment that will most commonly be recommended may be chosen by reason of the topography of the gas stations.

In another embodiment, the overhead fuel outlets are only on one side of the pump, depending on the actual topology of each gas station.

Thus, taking an island on the first pump approached they could be on the nearer side, and on the second pump on the far side, thus giving a possibility to service two additional vehicles that have passed the further pump and two additional vehicles that have not reached the first pump.

Together with the two vehicles at the pumps, this would mean the concurrent servicing of six vehicles on one side from the two pumps on the island and twelve vehicles from both sides of the two pumps.

In yet another embodiment, one side of the pump can be provided with one or two additional outlets and there can be none on the other side. By "side" it is to mean overhead to the right or the left, not the three outlets serving cars parallel on the other side of the island.

Thus, a gasoline pump system using the present invention can service twice as many cars as prior art systems, or more. The actual improvement in throughput depends on the actual topology of each gas station. Some gas stations, where there is less room available, may not be capable of using the present invention to full benefit, and there may be gas stations where the invention cannot be used at all.

Where applicable, the use of the invention can reduce the waiting time at gas stations and will increase the profits of gas station owners due to increased efficiency and better use of the available resources.

What is claimed is:

1. A gasoline pump system for concurrent filling of more than two cars, tanks or containers with gasoline or other liquid petroleum products, comprising:

A. a plurality of fuel outlets on each side of the pump system, wherein each outlet is supplied by a fuel pump and further includes flowmeter means for measuring the amount of fuel delivered through that outlet;

B. a plurality of sets of operator interface means on each side of the pump system, wherein each set comprises input means for selecting the type of fuel for one of the fuel outlets and display means for indicating information related to a vehicle filling through that fuel outlet;

C. means for enabling each driver to identify the outlet used for filling his/her car, and to distinguish it from outlets used for filling other cars; and D. means for guiding car drivers to a gasoline pump system having an outlet available for fueling at any instant of time.

2. The gasoline pump system according to claim 1, wherein the driver guiding means comprise availability display means for indicating a fuel type which can be filled at that gasoline pump system and wherein the display means are visible to drivers who are looking for an available filling outlet.

3. The gasoline pump system according to claim 1, wherein the driver guiding means comprise availability display means for indicating a fuel type which can be filled at that gasoline pump system and wherein the availability display means are visible to drivers entering the filling station.

4. The gasoline pump system according to claim 1, wherein each outlet delivers a different type of fuel and the driver guiding means comprise availability display means for indicating all the fuel types which are now delivered at that gasoline pump system and wherein the availability display means are visible to drivers who are looking for an available filling outlet.

5. The gasoline pump system according to claim 1, wherein each outlet delivers a different type of fuel and the driver guiding means comprise availability display means for indicating all the fuel types which are now delivered at that gasoline pump system and wherein the availability display means are visible to drivers entering the filling station.

6. The gasoline pump system according to claim 1, wherein each outlet delivers a different type of fuel and wherein the outlet distinguishing means comprise availability display means for displaying, for each filling outlet, the cost together with an indication of the fuel type being filled.

7. The gasoline pump system according to wherein each outlet includes unique identifying means and wherein the outlet distinguishing means comprise availability display means for displaying, for each filling outlet, the cost together with the associated outlet identifying means.

* * * * *